US007592989B2

(12) United States Patent
Shen

(10) Patent No.: US 7,592,989 B2
(45) Date of Patent: Sep. 22, 2009

(54) METHOD FOR ELIMINATING RESIDUAL IMAGE IN DISPLAY DEVICE

(75) Inventor: Chia-Hui Shen, Hsinchu (TW)

(73) Assignee: Prime View International Co., Ltd., Hsinchu (TW)

( * ) Notice: Subject to any disclaimer, the term of this patent is extended or adjusted under 35 U.S.C. 154(b) by 661 days.

(21) Appl. No.: 11/361,586

(22) Filed: Feb. 24, 2006

(65) Prior Publication Data

US 2007/0139347 A1 Jun. 21, 2007

(30) Foreign Application Priority Data

Dec. 20, 2005 (TW) ..... 94145223 A

(51) Int. Cl.
*G09G 3/36* (2006.01)

(52) U.S. Cl. ..... 345/87

(58) Field of Classification Search ..... 345/87, 345/55, 211

See application file for complete search history.

(56) References Cited

U.S. PATENT DOCUMENTS 6,147,888 A * 11/2000 Rivet ..... 363/143

FOREIGN PATENT DOCUMENTS

JP 2005-157157 * 6/2005
TW 499666 * 8/2002
TW 530284 * 5/2003

OTHER PUBLICATIONS

English language translation of JP 2005-157157.
English language translation of abstract of TW 530284.
English language translation of abstract of TW 499666.

* cited by examiner

*Primary Examiner*—Richard Hjerpe
*Assistant Examiner*—Leonid Shapiro
(74) *Attorney, Agent, or Firm*—Thomas, Kayden, Horstemeyer & Risley

(57) ABSTRACT

A gate driver circuit for eliminating power-off residual image form a display device is provided. The gate driver circuit comprises a first capacitor, a diode, a second capacitor and a regulator circuit. The first capacitor filters out high frequency surge and high frequency noise of an input voltage. The diode receives the input voltage and charges up the second capacitor by forwarding charges to the second capacitor. The diode also provides an input voltage to the regulator circuit. Finally, the voltage level transformer of the regulator circuit transmits an output voltage to the logic circuit of the display device.

12 Claims, 3 Drawing Sheets

METHOD FOR ELIMINATING RESIDUAL IMAGE IN DISPLAY DEVICE

CROSS-REFERENCE TO RELATED APPLICATION

This application claims the priority benefit of Taiwan application serial no. 94145223, filed on Dec. 20, 2005. All disclosure of the Taiwan application is incorporated herein by reference.

BACKGROUND OF THE INVENTION

1. Field of the Invention

The present invention relates to a gate driver circuit. More particularly, the present invention relates to a gate driver circuit for eliminating residual image from a display device.

2. Description of the Related Art

FIG. 1 is a driving timing sequence diagram for a thin film transistor (TFT) liquid crystal display (LCD) device. As shown in FIG. 1, the conventional TFT LCD includes a display panel and a back light module. At present, the internal start-up sequence for the TFT LCD includes switching on the main power source (as shown in curve A) of the TFT LCD through the time sequence $t_{N1}$. This includes applying a voltage to the common electrode of the TFT LCD and the pixel electrode. Then, in time sequence $t_{N2}$, image signal (as shown in curve B) is input to the pixel structure of the TFT LCD. Next, in time sequence $t_{N3}$, the back light module is turned on (as shown in curve C) to provide the display panel with a light source and display an image on the TFT LCD. Furthermore, as shown in FIG. 1, the internal shut down sequence of the conventional TFT LCD includes a sequence of steps, which is simply the reverse of the start-up sequence. First, in the time sequence $t_{F1}$, the back light module is shut down, and then the image signal fed into the pixel structure terminates in the time sequence $t_{F2}$. After that, the main power source of the TFT LCD is turned off in the time sequence $t_{F3}$.

Accordingly, some time after shutting down the back light module but before terminating the image signal, that is, in the time interval between $t_{F1}$, to $t_{F2}$ (typically, about 16.7 msec), the image signal still exists within the pixel structure and residual electric charges still exist on the pixel electrode. These residual charges do not have an effective exit path so that they can only be dissipated after the passage of a period. Therefore, a residual image frequently still persists on the TFT LCD for a while onward from the time sequence $t_{F3}$ after turning off.

FIG. 2 shows a conventional gate circuit for driving a display device. FIG. 3 is a timing diagram showing the conventional power-off logic-driving sequence of a display device. As shown in FIGS. 2 and 3, when the power source of the display device is on, the inductor 201, the capacitors 203, 205 together with the integrated regulator circuit 207 in FIG. 2 provide the source power (VDD) necessary for driving the logic circuit of the display device. Meanwhile, according to the logic state (VDD or VSS) of the logic circuit of the display device and through the level shifter of channel circuits in the gate driver, the gate logic-driving source (VGH, VGL) converts the logic state (VDD or VSS) into a gate logic-driving source (VGH or VGL) for turning on or shutting down the thin film transistor in the pixel structure within the display device.

Then, when the display device is shut down (shown by the dash line I in FIG. 3), the shutting down of the logic-driving source (VDD) and the gate logic-driving source (VGH, VGL) are unanimous. Thus, after shutting down the display device, the gate logic-driving source (VGH, VGL) still has some residual electric charges to turn on or off the thin film transistors of the pixel structures inside the display device and produce a residual image.

To resolve aforesaid problem, three controlling integrated circuits (IC) together with a microprocessor are conventionally used after the timing sequence $t_{F3}$ for controlling the shut-down timing sequence of the driving sources (VDD, VGH, VGL) required by the logic circuit of the display device. Thus, when the display device is shut down, the shutting sequence of the logic-driving source (VDD) is extended so that all the thin film transistors of the pixel structures inside the display device remain on, allowing the pixel electrode to discharge rapidly and eliminate any residual image.

However, because the conventional method demands the deployment of three additional controlling ICs and a microprocessor for controlling the shutdown timing sequence of the driving sources (VDD, VGH, VGL) in the logic circuit of the display device, the production cost is increased considerably.

SUMMARY OF THE INVENTION

Accordingly, at least one objective of the present invention is to provide a gate driver circuit for a display device that can eliminate residual image which is resulted from shutting down the display device.

In the present invention, a voltage level conversion of an input voltage is carried out and then the voltage is submitted to the logic circuit of the display device as a driving source (VDD). The gate driver circuit of the present invention includes a first capacitor, a diode, a second capacitor and a regulator circuit. The first capacitor filters out high frequency surge and high frequency noise of an input voltage. The diode receives the input voltage and charges up the second capacitor by forwarding charges to the second capacitor. The diode also provides an input voltage to the regulator circuit. Finally, the voltage level transformer of the regulator circuit transmits an output voltage to the logic circuit of the display device.

In the present invention, the power source (VDD) needed to drive the logic circuit inside the display device is extended when the display device is shut down. Hence, there is no need to use three controllers and a microprocessor to control the shutdown sequence as in the conventional technique. As a result, the overall production cost is reduced.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
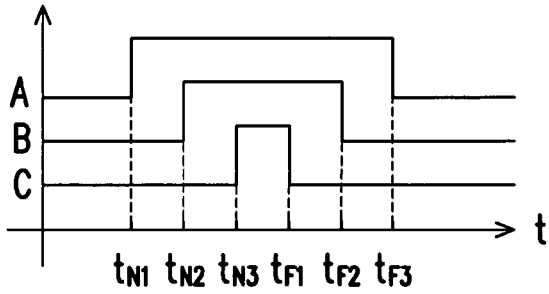
FIG. 1 (PRIOR ART)
FIG. 1 is a driving timing sequence diagram for a thin film transistor liquid crystal display device.
Figure 2:
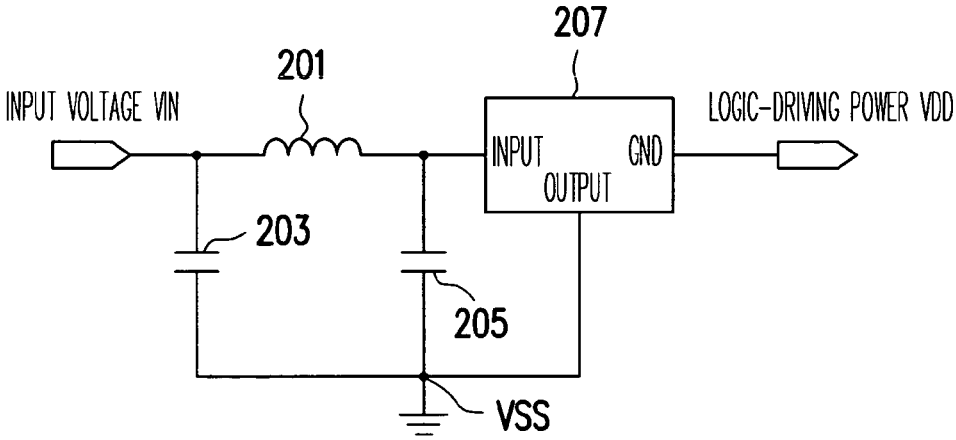
FIG. 2 (PRIOR ART)
FIG. 2 shows a conventional gate circuit for driving a display device.
Figure 3:
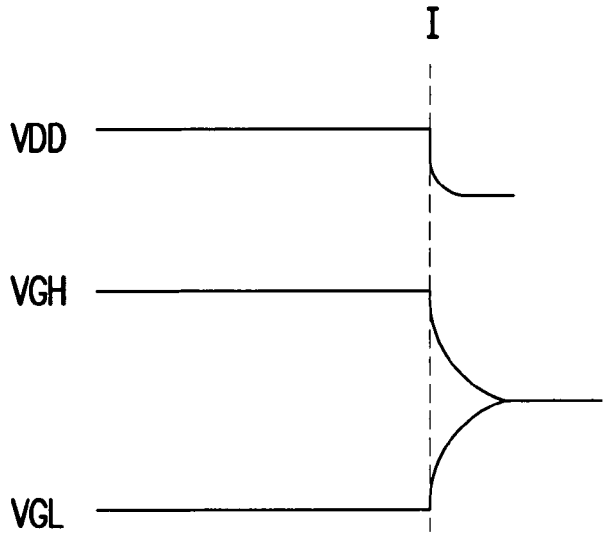
FIG. 3 (PRIOR ART)
FIG. 3 is a time diagram showing the conventional power-off logic-driving sequence of a display device.

Reference will now be made in detail to the present preferred embodiments of the invention, examples of which are illustrated in the accompanying drawings. Wherever possible, the same reference numbers are used in the drawings and the description to refer to the same or like parts.

Figure 4:
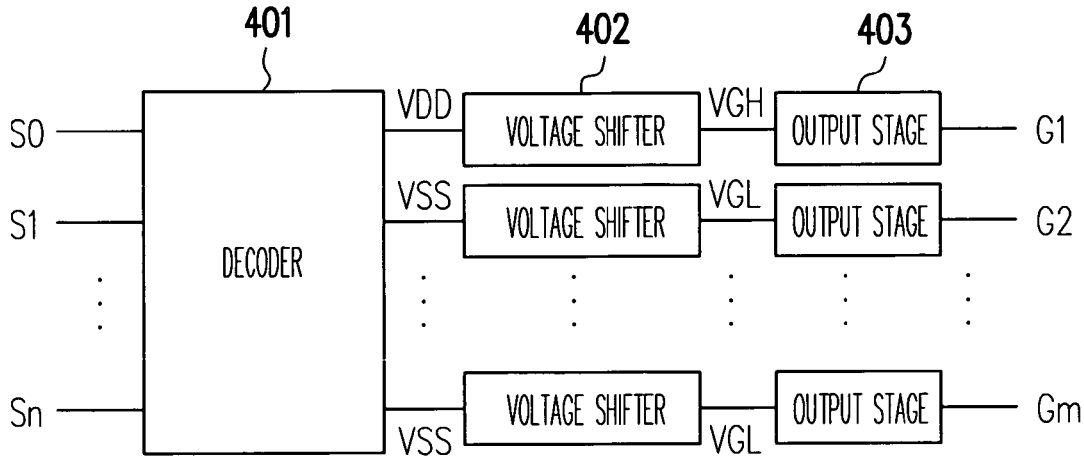
FIG. 4 is a block diagram showing the conventional architecture of the gate driver circuit of a display device.

FIG. 4 is a block diagram showing the conventional architecture of the gate driver circuit of a display device. As shown in FIG. 4, the decoder 401 has a plurality of output terminals. Each output terminal is coupled to a voltage shifter and an output stage so that various channel circuits are produced. Finally, the channel circuits are coupled to the respective gate lines G1~Gm of the display device.

The decoder 401 receives the control signals S0~Sn provided by the shift registers. The control signals S0~Sn designate the gate lines of the display device to be driven. For example, if the gate line G1 needs to be driven, the decoder 401 will output a logic 1 (that is, the logic-driving source VDD provided in the present invention) to the voltage shifter 402 after decoding the control signals S0~Sn. Meanwhile, a logic 0 (that is, the reference voltage VSS provided in the present invention) will be output to other voltage shifters. Then, according to the input logic 1 signal, the voltage shifter 402 will increase the logic-driving source VDD to the gate logic-driving source VGH and output to a corresponding output stage. In the meantime, according to the input logic 0 signal, the voltage shifter 402 will lower the reference potential VSS to the gate logic-driving source VGL and output to a corresponding output stage. As a result, the gate line G1 turns on the thin film transistor in the pixel structure inside the display device due to the logic 1 level while the other gate lines G2~Gm shut down the thin film transistors due to the logic 0 level.

Figure 5:
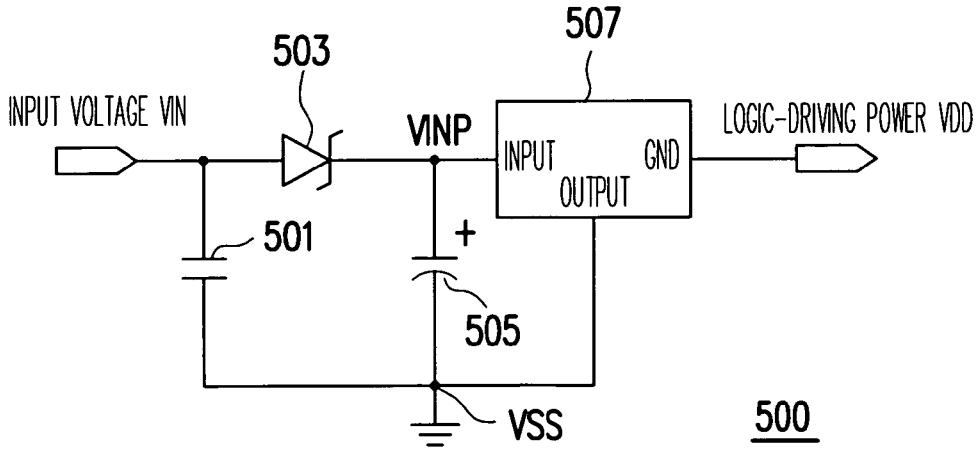
FIG. 5 is a gate driver circuit according to one preferred embodiment of the present invention.

FIG. 5 is a gate driver circuit according to one preferred embodiment of the present invention. As shown in FIG. 5, the gate driver circuit 500 in the present invention includes a capacitor 501, a diode 503, a second capacitor 505 and a regulator circuit 507. The first capacitor 501 is coupled to the input voltage pin VIN and the reference potential VSS. The anode terminal of the diode 503 receives the input voltage VIN and the cathode terminal of the diode 503 is coupled to the positive terminal of the second capacitor 505 and the input terminal of the regulator circuit 507 respectively. Furthermore, the cathode terminal of the second capacitor 505 and the ground terminal of the regulator circuit 507 are coupled to the reference potential VSS. Finally, through the voltage level transformation of the regulator circuit 507, the logic-driving source VDD is provided to the logic circuit of the display device.

In the present embodiment, the first capacitor 501 will filter out the high frequency surge and high frequency noise in the input voltage VIN and then provide a stable input voltage VIN so that the diode 503 becomes forward conducting. In addition, an input voltage VINP (VIN −0.25V) is provided to the input terminal of the regulator circuit 507 and the second capacitor 505 is charged. Then, the regulator circuit 507 performs a voltage level transformation of the input voltage VINP (VIN −0.25V). Finally, a logic-driving source VDD is provided to the logic circuit of the display device.

In one preferred embodiment of the present invention, the first capacitor 501 is a ceramic capacitor or a tantalum capacitor with a capacitance of about 0.1 μF. The diode 503 can be a Schottky diode because a Schottky diode has a lower forward conducting voltage, for example, as low as 0.25V. Therefore, when the display device is shut down, the difference in voltage at the two ends of the diode 503 is small (VIN −0.25V) so that the back current in the diode 505 is small. Furthermore, the use of the second capacitor 505 to store electric charges can delay the output of the logic-driving source VDD from the regulator circuit 507 by a time period. In the present invention, the second capacitor 505 can be an electrolytic capacitor as well.

In addition, the capacitance of the second capacitor 505 will determine the delay period of the logic-driving source VDD after shutting down the display device. When the capacitance is larger, the backward extension of the time sequence D1 of the logic-driving source VDD is longer. Conversely, if the capacitance is smaller, the backward extension of the time sequence D2 of the logic-driving source VDD is shorter.

Figure 6:
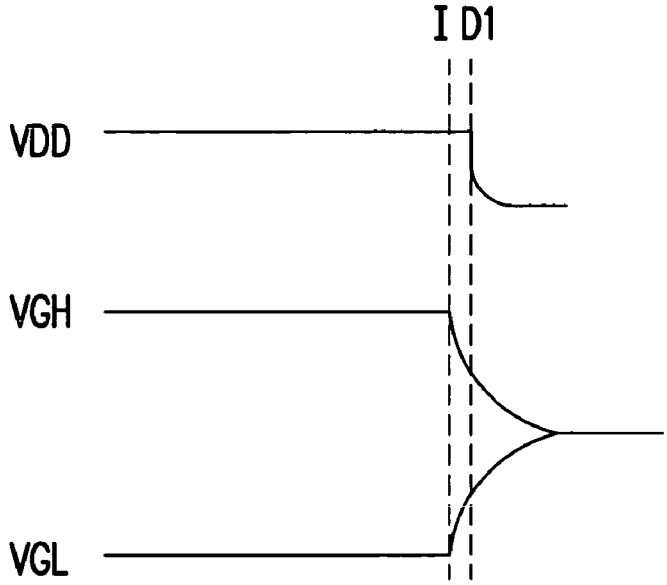
FIG. 6 is a time diagram showing the shutdown sequence of logic-driving sources according to one embodiment of the present invention.
Figure 7:
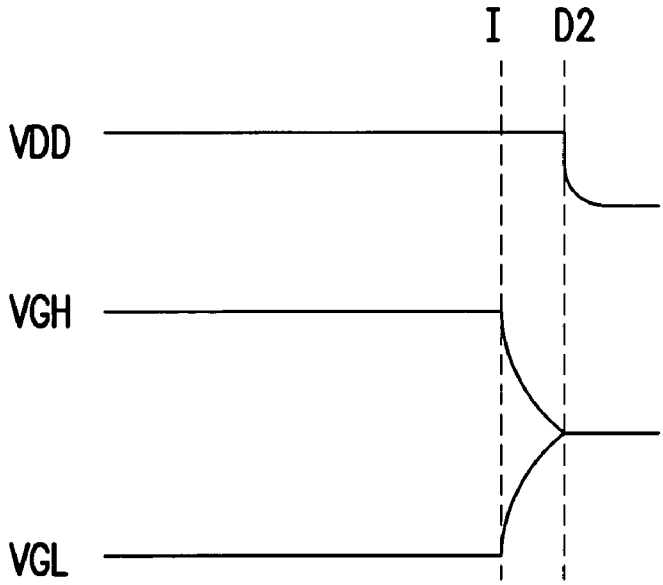
FIG. 7 is a time diagram showing the shutdown sequence of logic-driving sources according to another embodiment of the present invention.

FIGS. 6 and 7 are time diagrams showing the shutdown sequence of logic-driving sources for two different capacitance value for the second capacitor according to one embodiment of the present invention. As shown in FIGS. 5, 6 and 7, when the second capacitor 505 in FIG. 5 has a capacitance of about 330 μF, the logic-driving source VDD will produce a delay D1 after shutting down the display device. When the second capacitor 505 is raised to about 10000 μF, the logic-driving source VDD will produce a delay D2 after shutting down the display device. Although only two capacitance values for the second capacitor are provided, anyone familiar with the technique may notice that the actual value of the capacitance is not one of the major spirit in the present invention. In fact, anyone can adjust the capacitance of the second capacitor according to the actual requirements in a particular situation.

In summary, the present invention provides a gate driver circuit suitable for driving a display device. In addition, the present invention utilizes a diode and a second capacitor to extend the time sequence of the logic-driving source VDD during a shutdown of the display device. Hence, the thin film transistors of the pixel structures inside the display device are kept on longer to discharge the pixel electrodes so that any residual image is rapidly eliminated. Another advantage of the present invention is that three additional controlling ICs and an additional microprocessor are not required as in the conventional technique. Therefore, the production cost can be significantly reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A gate driver circuit for eliminating residual image in a display device, wherein the gate driver circuit converts an input voltage into an output voltage to provide the power source necessary for driving a logic circuit, the gate driver circuit comprising:

a first capacitor having a first terminal and a second terminal, wherein the first terminal is coupled to the input voltage and the second terminal is coupled to a reference potential;

a diode having an anode terminal that couples with the first terminal of the first capacitor to receive the input voltage;

a second capacitor coupled to a cathode terminal of the second diode and the reference potential; and a regulator circuit coupled to the cathode terminal of the diode to produce the output voltage for the logic circuit.

2. The gate driver circuit of claim 1, wherein the first capacitor is a ceramic capacitor, used for eliminating the high frequency surge and high frequency noise produced by the gate driver circuit.

3. The gate driver circuit of claim 1, wherein the first capacitor is a tantalum capacitor, used for eliminating the high frequency surge and high frequency noise produced by the gate driver circuit.

4. The gate driver circuit of claim 1, wherein the diode is a Schottky diode.

5. The gate driver circuit of claim 4, wherein the Schottky diode has a forward conducting voltage of about 0.25V.

6. The gate driver circuit of claim 1, wherein the second capacitor is an electrolytic capacitor.

7. The gate driver circuit of claim 1, wherein the second capacitor has a capacitance of about 330 μF.

8. The gate driver circuit of claim 1, wherein the second capacitor has a capacitance of about 1000 μF.

9. The gate driver circuit of claim 1, wherein the regulator circuit is an integrated regulator circuit.

10. The gate driver circuit of claim 1, wherein the input voltage is about +5V.

11. The gate driver circuit of claim 1, wherein the output voltage is about +3.3V.

12. The gate driver circuit of claim 1, wherein the driving source reference potential is the ground potential.

* * * * *